US010867621B2

(12) United States Patent
Khoury et al.

(10) Patent No.: US 10,867,621 B2
(45) Date of Patent: Dec. 15, 2020

(54) SYSTEM AND METHOD FOR CLUSTER-BASED AUDIO EVENT DETECTION

(71) Applicant: PINDROP SECURITY, INC., Atlanta, GA (US)

(72) Inventors: Elie Khoury, Atlanta, GA (US); Matthew Garland, Atlanta, GA (US)

(73) Assignee: Pindrop Security, Inc., Atlanta, GA (US)

( * ) Notice: Subject to any disclaimer, the term of this patent is extended or adjusted under 35 U.S.C. 154(b) by 0 days.

(21) Appl. No.: 16/200,283

(22) Filed: Nov. 26, 2018

(65) Prior Publication Data

US 2019/0096424 A1 Mar. 28, 2019

Related U.S. Application Data

(63) Continuation of application No. 15/610,378, filed on May 31, 2017, now Pat. No. 10,141,009.

(60) Provisional application No. 62/355,606, filed on Jun. 28, 2016.

(51) Int. Cl.

| | |
|---|---|
| ***G10L 25/45*** | (2013.01) |
| ***G10L 25/51*** | (2013.01) |
| ***G10L 25/27*** | (2013.01) |
| ***G10L 25/78*** | (2013.01) |

(52) U.S. Cl.

CPC ..... *G10L 25/45* (2013.01); *G10L 25/27* (2013.01); *G10L 25/51* (2013.01); *G10L 25/78* (2013.01)

(58) Field of Classification Search

CPC . G10L 15/04; G10L 2015/0631; G10L 25/45; G10L 25/48

See application file for complete search history.

(56) References Cited

U.S. PATENT DOCUMENTS 5,598,507 A 1/1997 Kimber et al.
5,659,662 A 8/1997 Wilcox et al.

(Continued)

OTHER PUBLICATIONS

Temko, Andrey, and Climent Nadeu. "Acoustic event detection in meeting-room environments." Pattern Recognition Letters 30.14 (2009): 1281-1288. (Year: 2009).*

(Continued)

*Primary Examiner* — Brian L Albertalli
(74) *Attorney, Agent, or Firm* — Foley & Lardner LLP

(57) ABSTRACT

Methods, systems, and apparatuses for audio event detection, where the determination of a type of sound data is made at the cluster level rather than at the frame level. The techniques provided are thus more robust to the local behavior of features of an audio signal or audio recording. The audio event detection is performed by using Gaussian mixture models (GMMs) to classify each cluster or by extracting an i-vector from each cluster. Each cluster may be classified based on an i-vector classification using a support vector machine or probabilistic linear discriminant analysis. The audio event detection significantly reduces potential smoothing error and avoids any dependency on accurate window-size tuning. Segmentation may be performed using a generalized likelihood ratio and a Bayesian information criterion, and the segments may be clustered using hierarchical agglomerative clustering. Audio frames may be clustered using K-means and GMMs.

20 Claims, 9 Drawing Sheets

(56) References Cited

U.S. PATENT DOCUMENTS

| | | | | |
|---|---|---|---|---|
| 7,295,970 | B1 * | 11/2007 | Gorin | G10L 17/12 704/221 |
| 7,739,114 | B1 | 6/2010 | Chen et al. | |
| 9,064,491 | B2 * | 6/2015 | Rachevsky | G10L 15/063 |
| 2003/0231775 | A1 | 12/2003 | Wark | |
| 2003/0236663 | A1 | 12/2003 | Dimitrova et al. | |
| 2006/0058998 | A1 * | 3/2006 | Yamamoto | G10L 17/00 704/254 |
| 2012/0185418 | A1 | 7/2012 | Capman et al. | |
| 2013/0041660 | A1 | 2/2013 | Waite | |
| 2014/0046878 | A1 | 2/2014 | Lecomte et al. | |
| 2014/0278412 | A1 | 9/2014 | Scheffer et al. | |
| 2015/0199960 | A1 | 7/2015 | Huo et al. | |
| 2015/0269931 | A1 | 9/2015 | Senior et al. | |
| 2015/0310008 | A1 * | 10/2015 | Thudor | G06F 16/433 707/610 |
| 2015/0348571 | A1 | 12/2015 | Koshinaka et al. | |
| 2017/0169816 | A1 * | 6/2017 | Blandin | G10L 15/08 |

OTHER PUBLICATIONS

Temko, Andrey, and Climent Nadeu. "Classification of acoustic events using SVM-based clustering schemes." Pattern Recognition 39.4 (2006): 682-694. (Year: 2006).*

Huang, Zhen, et al. "A blind segmentation approach to acoustic event detection based on i-vector." Interspeech. 2013. (Year: 2013).*

Pigeon, Stéphane, Pascal Druyts, and Patrick Verlinde. "Applying logistic regression to the fusion of the NIST'99 1-speaker submissions." Digital Signal Processing 10.1-3 (2000): 237-248. (Year: 2000).

Novoselov, Sergey, Timur Pekhovsky, and Konstantin Simonchik. "SIC speaker recognition system for the NIST i-vector challenge." Odyssey: The Speaker and Language Recognition Workshop. 2014. (Year: 2014).

Gish, Herbert, M-H. Siu, and Robin Rohlicek. "Segregation of speakers for speech recognition and speaker identification." Acoustics , Speech, and Signal Processing, 1991. ICASSP-91., 1991 International Conference on. IEEE, 1991. (Year: 1991).

Xue, Jiachen, et al. "Fast query by example of environmental sounds via robust and efficient cluster-based indexing." Acoustics, Speech and Signal Processing, 2008. ICASSP 2008. IEEE International Conference on. IEEE, 2008. (Year: 2008).

El-Khoury, Elie, Christine Senac, and Julien Pinquier. "Improved speaker diarization system for meetings." Acoustics, Speech and Signal Processing, 2009. ICASSP 2009. IEEE International Conference on. IEEE, 2009. (Year 2009).

Dehak, Najim, et al. "Front-end factor analysis for speaker verification. " IEEE Transactions on Audio, Speech, and Language Processing 19.4 (2011): 788-798. (Year: 2011).

Prazak, Jan, and Jan Silovsky. "Speaker diarization using PLDA-based speaker clustering." Intelligent Data Acquisition and Advanced Computing Systems (IDAACS), 2011 IEEE 6th International Conference on. vol. 1. IEEE, 2011. (Year: 2011).

Rouvier, Mickael, et al. "An open-source state-of-the-art toolbox for broadcast news diarization." Interspeech. 2013. (Year: 2013).

Meignier, Sylvain, and Teva Merlin. "LIUM SpkDiarization: an open source toolkit for diarization." CMU SPUD Workshop. 2010. Year: 2010).

Luque, Jordi, Carlos Segura, and Javier Hernando. "Clustering initialization based on spatial information for speaker diarization of meetings." Ninth Annual Conference of the International Speech Communication Association. 2008. (Year: 2008).

Atrey, Pradeep K., Namunu C. Maddage, and Mohan S. Kankanhalli. "Audio based event detection for multimedia surveillance." Acoustics, Speech and Signal Processing, 2006. ICASSP 2006 Proceedings. 2006 IEEE International Conference on. vol. 5. IEEE, 2006. (Year: 2006).

Shajeesh, K. U., et al. "Speech enhancement based on Savitzky-Golay smoothing filter." International Journal of Computer Applications 57.21 (2012). (Year 2012).

Shum, Stephen, et al. "Exploiting intra-conversation variability for speaker diarization." Twelfth Annual Conference of the International Speech Communication Association. 2011. (Year: 2011).

Gencoglu Oguzhan et al: "Recognition of Accoustic Events Using Deep Neural Networks", 2014 22nd European Signal Processing Conference (ELISIPC0), EURASIP, Sep. 1, 2014 (Sep. 1, 2014), pp. 506-510, XP032681786.

International Search Report (PCT/ISA/210) issued in the corresponding International Application No. PCT/US2017/039697, dated Sep. 20, 2017.

Written Opinion of the International Searching Authority (PCT/ISA/237) issued in the corresponding International Application No. PCT/US2017/039697, dated Sep. 20, 2017.

* cited by examiner

SYSTEM AND METHOD FOR CLUSTER-BASED AUDIO EVENT DETECTION

CROSS-REFERENCE TO RELATED APPLICATIONS

The present application is a Continuation of application Ser. No. 15/610,378, filed May 31, 2017, which claims priority to U.S. Provisional Patent Application Ser. No. 62/355,606, filed Jun. 28, 2016, the entire disclosure of which is hereby incorporated by reference.

BACKGROUND

Audio event detection (AED) aims to identify the presence of a particular type of sound data within an audio signal. For example, AED may be used to identify the presence of the sound of a microwave oven running in a region of an audio signal. AED may also include distinguishing among various types of sound data within an audio signal. For example, AED may be used to classify sounds such as, for example, silence, noise, speech, a microwave oven running, or a train passing.

Speech activity detection (SAD), a special case of AED, aims to distinguish between speech and non-speech (e.g., silence, noise, music, etc.) regions within audio signals. SAD is frequently used as a preprocessing step in a number of applications such as, for example, speaker recognition and diarization, language recognition, and speech recognition. SAD is also used to assist humans in analyzing recorded speech for applications such as forensics, enhancing speech signals, and improving compression of audio streams before transmission.

A wide spectrum of approaches exists to address SAD. Such approaches range from very simple systems such as energy-based classifiers to extremely complex techniques such as deep neural networks. Although SAD has been performed for some time now, recent studies on real-life data have shown that state-of-the-art SAD and AED techniques lack generalization power.

SUMMARY

As recognized by the inventors, SAD systems/classifiers (and AED systems/classifiers generally) that operate at the frame or segment level leave room for improvement in their accuracy. Further, many approaches that operate at the frame or segment level may be subject to high smoothing error, and their accuracy is highly dependent on the size of the window. Accuracy may be improved by performing SAD or AED at the cluster level. In at least one embodiment, an i-vector may be extracted from each cluster, and each cluster may be classified based on it i-vector. In at least one embodiment, one or more Gaussian mixture models may be learned, and each cluster may be classified based on the one or more Gaussian mixture models.

As recognized by the inventors, SAD systems/classifiers (and AED systems/classifiers generally) that operate at the frame or segment level leave room for improvement in their accuracy. Further, many approaches that operate at the frame or segment level may be subject to high smoothing error, and their accuracy is highly dependent on the size of the window. Accuracy may be improved by performing SAD or AED at the cluster level. In at least one embodiment, an i-vector may be extracted from each cluster, and each cluster may be classified based on its i-vector. In at least one embodiment, one or more Gaussian mixture models may be learned, and each cluster may be classified based on the one or more Gaussian mixture models.

Further, as recognized by the inventors, unsupervised SAD classifiers are highly dependent on the balance between regions containing a particular audio event and regions not containing the particular audio event. In at least one embodiment, each cluster may be classified by a supervised classifier on the basis of the cluster's i-vector. In at least one embodiment, one or more Gaussian mixture models may be learned, and each cluster may be classified based on the one or more Gaussian mixture models.

Further, as recognized by the inventors, some supervised classifiers fail to generalize to unseen conditions. The computational complexity of training and tuning a supervised classifier may be high. In at least one embodiment, i-vectors are low-dimensional feature vectors that effectively preserve or approximate the total variability of an audio signal. In at least one embodiment, due to the low dimensionality of i-vectors, the training time of one or more supervised classifiers may be reduced, and the time and/or space complexity of a classification decision may be reduced.

The present disclosure generally relates to audio signal processing. More specifically, aspects of the present disclosure relate to performing audio event detection, including speech activity detection, by extracting i-vectors from clusters of audio frames or segments and by applying Gaussian mixture models to clusters of audio frames or segments.

In general, one aspect of the subject matter described in this specification can be embodied in a computer-implemented method for audio event detection, comprising: forming clusters of audio frames of an audio signal, wherein each cluster includes audio frames having similar features; and determining, for at least one of the clusters of audio frames, whether the cluster includes a type of sound data using a supervised classifier.

In at least one embodiment, the computer-implemented method further comprises forming segments from the audio signal using generalized likelihood ratio (GLR) and Bayesian information criterion (BIC).

In at least one embodiment, the forming segments from the audio signal using generalized likelihood ratio and Bayesian information criterion includes using a Savitzky Golay filter.

In at least one embodiment, the computer-implemented method further comprises using GLR to detect a set of candidates for segment boundaries; and using BIC to filter out at least one of the candidates.

In at least one embodiment, the computer-implemented method further comprises clustering the segments using hierarchical agglomerative clustering.

In at least one embodiment, the computer-implemented method further comprises using K-means and at least one Gaussian mixture model (GMM) to form the clusters of audio frames.

In at least one embodiment, a number k equal to a total number of the clusters of audio frames is equal to 1 plus a ceiling function applied to a quotient obtained by dividing a duration of a recording of the audio signal by an average duration of the clusters of audio frames.

In at least one embodiment, the GMM is learned using the expectation maximization algorithm.

In at least one embodiment, the determining, for at least one of the clusters of audio frames, whether the cluster includes a type of sound data using a supervised classifier includes: extracting an i-vector for the at least one of the clusters of audio frames; and determining whether the at least one of the clusters includes the type of sound data based on the extracted i-vector.

In at least one embodiment, the at least one of the clusters is classified using probabilistic linear discriminant analysis.

In at least one embodiment, the at least one of the clusters is classified using at least one support vector machine.

In at least one embodiment, whitening and length normalization are applied for channel compensation purposes, and wherein a radial basis function kernel is used.

In at least one embodiment, features of the audio frames include at least one of Mel-Frequency Cepstral Coefficients, Perceptual Linear Prediction, or Relative Spectral Transform—Perceptual Linear Prediction.

In at least one embodiment, the computer-implemented method further comprises performing score-level fusion using output of a first audio event detection (AED) system and output of a second audio event detection (AED) system, the first AED system based on a first type of feature and the second AED system based on a second type of feature different from the first type of feature, wherein the first AED system and the second AED system make use of a same type of supervised classifier, and wherein the score-level fusion is done using logistic regression.

In at least one embodiment, the type of sound data is speech data.

In at least one embodiment, the supervised classifier includes a Gaussian mixture model trained to classify the type of sound data.

In at least one embodiment, at least one of a probability or a log likelihood ratio that the at least one of the clusters of audio frames belongs to the type of sound data is determined using the Gaussian mixture model.

In at least one embodiment, a blind source separation technique is performed before the forming segments from the audio signal using generalized likelihood ratio (GLR) and Bayesian information criterion (BIC).

In general, another aspect of the subject matter described in this specification can be embodied in a system that performs audio event detection, the system comprising: at least one processor; a memory device coupled to the at least one processor having instructions stored thereon that, when executed by the at least one processor, cause the at least one processor to: determine, using K-means, an initial partition of audio frames, wherein a plurality of the audio frames include features extracted from temporally overlapping audio that includes audio from a first audio source and audio from a second audio source; based on the partition of audio frames, determine, using Gaussian Mixture Model (GMM) clustering, clusters including a plurality of audio frames, wherein the clusters include a multi-class cluster having a plurality of audio frames that include features extracted from temporally overlapping audio that includes audio from the first audio source and audio from the second audio source; extract i-vectors from the clusters; determine, using a multi-class classifier, a score for the multi-class cluster; and determine, based on the score for the multi-class cluster, a probability estimate that the multi-class cluster includes a type of sound data.

In at least one embodiment, the type of sound data is speech.

In at least one embodiment, the score for the multi-class cluster is a first score for the multi-class cluster, the probability estimate is a first probability estimate, the type of sound data is a first type of sound data, and the at least one processor is further caused to: determine, using the multi-class classifier, a second score for the multi-class cluster; and determine, based on the second score for the multi-class cluster, a second probability estimate that the multi-class cluster includes a second type of sound data.

In at least one embodiment, the first type of sound data is speech, and the second audio source is a person speaking on a telephone, a passenger vehicle, a telephone, a location environment, an electrical device, or a mechanical device.

In at least one embodiment, the at least one processor is further caused to determine the probability estimate using Platt scaling.

In general, another aspect of the subject matter described in this specification can be embodied in an apparatus for performing audio event detection, the apparatus comprising: an input configured to receive an audio signal from a telephone; at least one processor; a memory device coupled to the at least one processor having instructions stored thereon that, when executed by the at least one processor, cause the at least one processor to: extract features from audio frames of the audio signal; determine a number of clusters; determine a first Gaussian mixture model using an expectation maximization algorithm based on the number of clusters; determine, based on the first Gaussian mixture model, clusters of the audio frames, wherein the clusters include a multi-class cluster including feature vectors having features extracted from temporally overlapping audio that includes audio from a first audio source and audio from a second audio source; learn, using a first type of sound data, a second Gaussian mixture model; learn, using a second type of sound data, a third Gaussian mixture model; estimate, using the second Gaussian mixture model, a probability that the multi-class cluster includes the first type of sound data; and estimate, using the third Gaussian mixture model, a probability that the multi-class cluster includes the second type of sound data, wherein the first audio source is a person speaking on the telephone.

In at least one embodiment, the second audio source emits audio transmitted by the telephone, and wherein the second audio source is a person, a passenger vehicle, a telephone, a location environment, an electrical device, or a mechanical device.

In at least one embodiment, the at least one processor is further caused to use K-means to determine clusters of the audio frames.

It should be noted that embodiments of some or all of the processor and memory systems disclosed herein may also be configured to perform some or all of the method embodiments disclosed above. In addition, embodiments of some or all of the methods disclosed above may also be represented as instructions and/or information embodied on non-transitory processor-readable storage media such as optical or magnetic memory.

Further scope of applicability of the methods, systems, and apparatuses of the present disclosure will become apparent from the Detailed Description given below. However, it should be understood that the Detailed Description and specific examples, while indicating embodiments of the methods, systems, and apparatuses, are given by way of illustration only, since various changes and modifications within the spirit and scope of the concepts disclosed herein will become apparent to those having ordinary skill in the art from this Detailed Description.

BRIEF DESCRIPTION OF DRAWINGS

These and other objects, features, and characteristics of the present disclosure will become more apparent to those having ordinary skill in the art from a study of the following Detailed Description in conjunction with the appended claims and drawings, all of which form a part of this specification. In the drawings:

Figure 1:
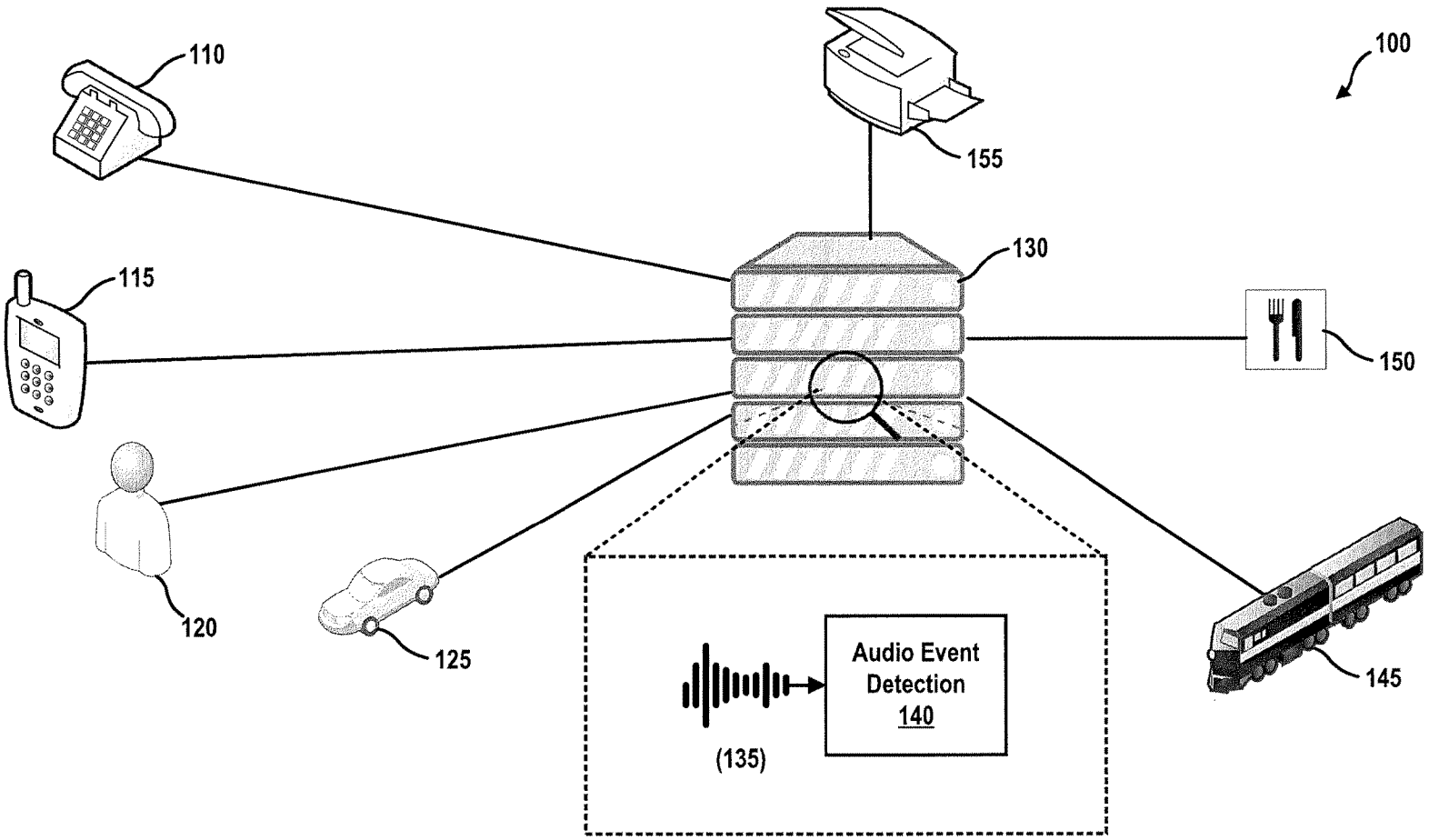
FIG. 1 is a block diagram illustrating an example system for audio event detection and surrounding environment in which one or more embodiments described herein may be implemented.

The headings provided herein are for convenience only and do not necessarily affect the scope or meaning of what is claimed in the present disclosure.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Various examples and embodiments of the methods, systems, and apparatuses of the present disclosure will now be described. The following description provides specific details for a thorough understanding and enabling description of these examples. One having ordinary skill in the relevant art will understand, however, that one or more embodiments described herein may be practiced without many of these details. Likewise, one skilled in the relevant art will also understand that one or more embodiments of the present disclosure can include other features not described in detail herein. Additionally, some well-known structures or functions may not be shown or described in detail below, so as to avoid unnecessarily obscuring the relevant description.

Existing SAD techniques are often categorized as either supervised or unsupervised. Unsupervised SAD techniques include, for example, standard real-time SADs such as those used in some telecommunication products (e.g. voice over IP). To meet the real-time requirements, these techniques combine a set of low-complexity, short-term features such as spectral frequencies, full-band energy, low-band energy, and zero-crossing rate extracted at the frame level (e.g., 10 milliseconds (ms)). In these techniques, the classification between speech and non-speech is made using either hard or adaptive thresholding rules.

More robust unsupervised techniques assume access to long-duration buffers (e.g., multiple seconds) or even the full audio recording. This helps to improve feature normalization and gives more reliable estimates of statistics. Examples of such techniques include energy-based bi-Gaussians, vector quantization, 4 Hz modulation energy, a posteriori signal-to-noise ratio (SNR) weighted energy distance, and unsupervised sequential Gaussian mixture models (GMMs) applied on 8-Mel sub-bands in the spectral domain.

Although unsupervised approaches to SAD do not require any training data, they often suffer from relatively low detection accuracy compared to supervised approaches. One main drawback is that unsupervised approaches are highly dependent on the balance between regions containing a particular audio event and regions not containing the particular audio event, e.g., speech and non-speech regions. For example, the energy-based bi-Gaussian technique, as used in SAD, is highly dependent on the balance between speech and non-speech regions.

Supervised SAD techniques include, for example, Gaussian mixture models (GMMs), hidden Markov models (HMM), Viterbi segmentation, deep neural network (DNN), recurrent neural network (RNN), and long short-term memory (LSTM) RNN. Different acoustic features may be used in supervised approaches, varying from standard features computed on short-term windows (e.g., 20 ms) to more sophisticated long-term features that involve contextual information such as frequency domain linear prediction (FDLP), voicing features, and Log-mel features.

Supervised methods use training data to learn their models and architectures. They typically obtain very high accuracy on seen conditions in the training set, but fail in generalizing to unseen conditions. Moreover, supervised approaches are more complex to tune, and are also time-consuming, especially during the training phase.

I-vectors are low-dimensional front-end feature vectors which may effectively preserve or approximate the total variability of a signal. The present disclosure provides methods and systems for audio event detection, including speech activity detection, by using i-vectors in combination with a supervised classifier or GMMs trained to classify a type q of sound data.

A common drawback of most existing supervised and unsupervised SAD approaches is that their decisions operate at the frame level (even in the case of contextual features), which cannot be reliable by itself, especially at boundaries between regions containing a particular audio event and regions not containing a particular audio event, e.g., speech and non-speech regions. Such approaches are thus subject to high smoothing error and are highly dependent on window-size tuning.

As used herein, an "audio frame" may be a window of an audio signal having a duration of time, e.g., 10 milliseconds (ms). In one or more embodiments, a feature vector may be extracted from an audio frame. In one or more embodiments, a "segment" is a group of contiguous audio frames. In accordance with one or more embodiments described herein, a "cluster" is considered to be a group of audio frames, and the audio frames in the group need not be contiguous. In accordance with one or more embodiments, in the context of hierarchical clustering, a "cluster" is a group of segments. Depending on context, an audio frame may be represented by features (or a feature vector) based on the audio frame. Thus, forming clusters of audio frames of an audio signal may be done by forming clusters of features (or feature vectors) based on audio frames.

Segments may be formed using, for example, generalized likelihood ratio (GLR) and Bayesian information criterion (BIC) techniques. The grouping of the segments into clusters may be done in a hierarchical agglomerative manner based on a BIC.

In contrast to existing approaches, the methods and systems for AED of the present disclosure are designed such that the classification decision (e.g., speech or non-speech) is made at the cluster level, rather than at the frame level. The methods and systems described herein are thus more robust to the local behavior of the features. Performing AED by applying i-vectors to clusters in this manner significantly reduces potential smoothing error, and avoids any dependency on accurate window-size tuning.

As will be described in greater detail below, the methods and systems for AED of the present disclosure operate at the cluster level. For example, in accordance with one or more embodiments, the segmentation and clustering of an audio signal or audio recording may be based on a generalized likelihood ratio (GLR) and a Bayesian information criterion (BIC). In accordance with at least one other embodiment, clustering may be performed using K-means and GMM clustering.

Clustering is suitable for i-vectors since a single i-vector may be extracted per cluster. Such an approach also avoids the computational cost of extracting i-vectors on overlapped windows, which is in contrast to existing SAD approaches that use contextual features.

FIG. 1 illustrates an example system for audio event detection and surrounding environment in which one or more of the embodiments described herein may be implemented. In accordance with at least one embodiment, the methods for AED using clustering of the present disclosure may be utilized in an audio event detection system 100 which may capture types of sound data from, without limitation, a telephone 110, a cell phone 115, a person 120, a car 125, a train 145, a restaurant 150, or an office device 155. The type(s) of sound data captured from the telephone 110 and the cell phone 115 may be sound captured from a microphone external to the telephone 110 or cell phone 115 that records ambient sounds including a phone ring, a person talking on the phone, and a person pressing buttons on the phone. Further, the type(s) of sound data captured from the telephone 110 and the cell phone 115 may be from sounds transmitted via the telephone 110 or cell phone 115 to a receiver that receives the transmitted sound. That is, the type(s) of sound data from the telephone 110 and the cell phone 115 may be captured remotely as the type(s) of sound data traverses the phone network.

The audio event detection system 100 may include a processor 130 that analyzes the audio signal 135 and performs audio event detection 140.

Figure 2:
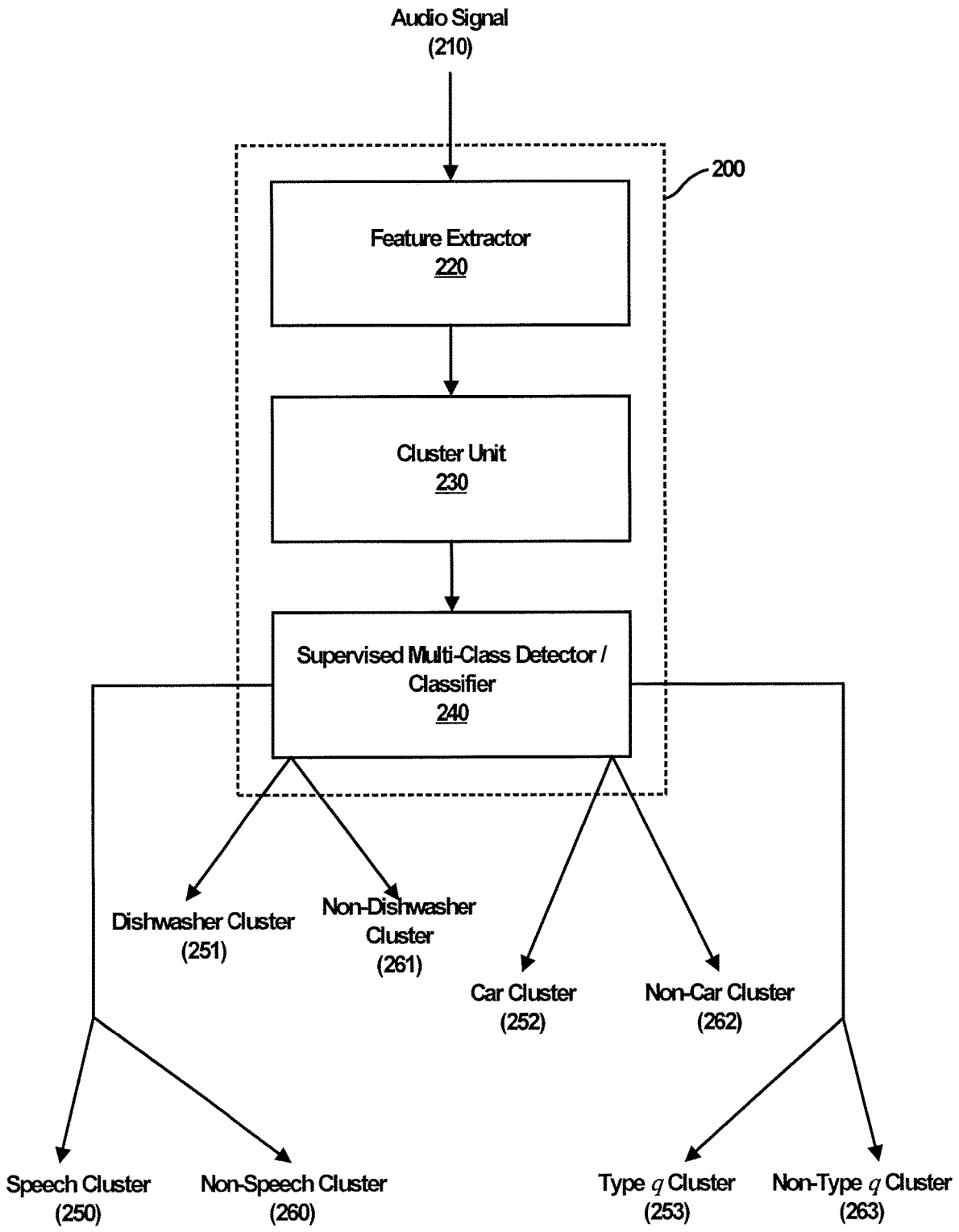
FIG. 2 is a block diagram illustrating an example system for audio event detection using clustering and a supervised multi-class detector/classifier according to one or more embodiments described herein.
Figure 7:
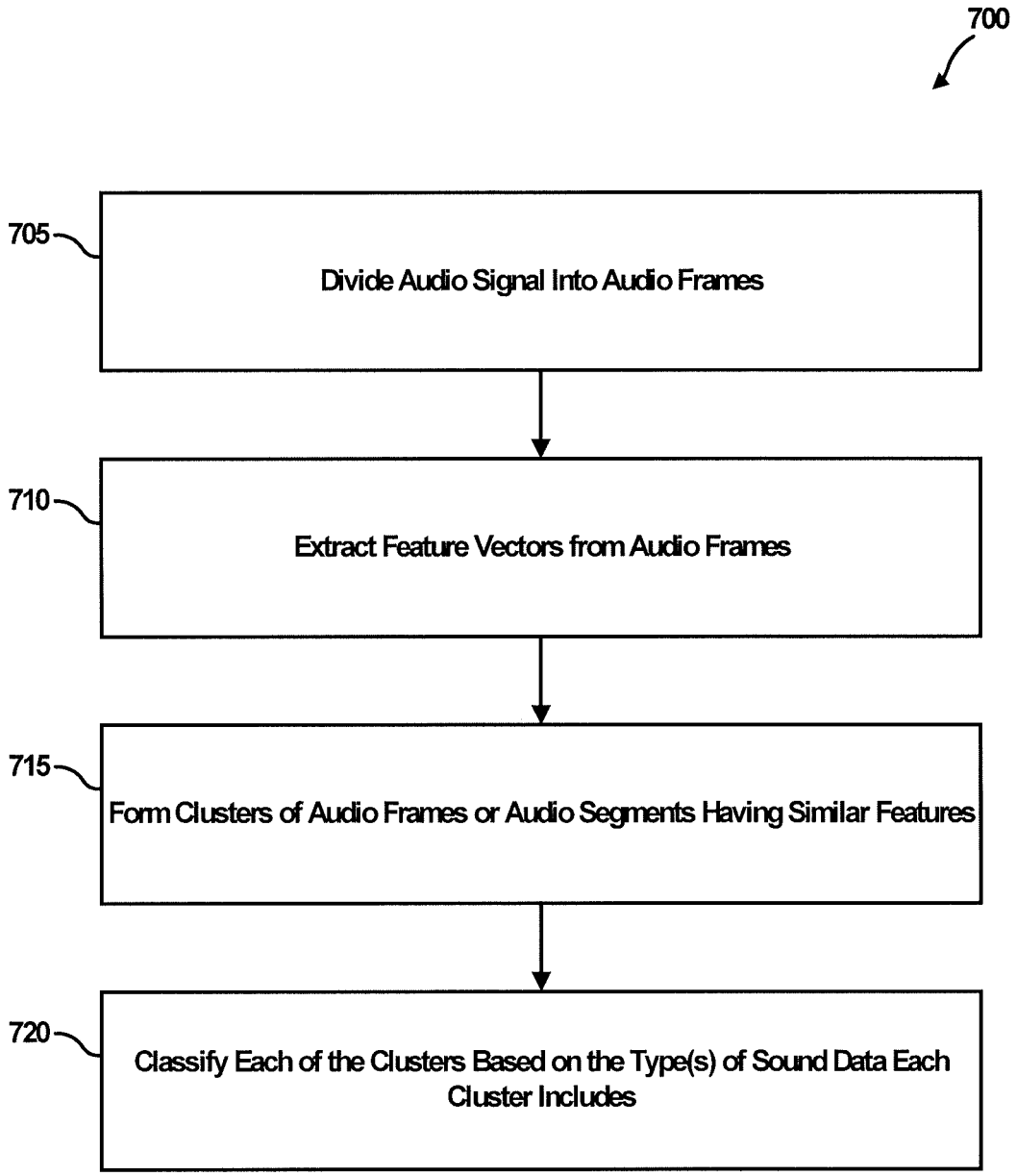
FIG. 7 is a flowchart illustrating an example method for audio event detection according to one or more embodiments described herein.

FIG. 2 is an example audio event detection system 200 according to one or more embodiments described herein. FIG. 7 is a flowchart illustrating an example method for audio event detection according to one or more embodiments described herein. In accordance with at least one embodiment, the system 200 may include feature extractor 220, cluster unit 230, and supervised multi-class detector/classifier 240 (e.g., a classifier that classifies i-vectors).

When an audio signal (210) is received at or input to the system 200, the feature extractor 220 may divide (705) the audio signal (210) into audio frames and extract or determine feature vectors from the audio frames (710). Such feature vectors may include, for example, Mel-Frequency Cepstral Coefficients (MFCC), Perceptual Linear Prediction (PLP), Relative Spectral Transform—Perceptual Linear Prediction (RASTA-PLP), and the like. In at least one embodiment, the feature extractor 220 may form segments from contiguous audio frames. The cluster unit 230 may use the extracted feature vectors to form clusters of audio frames or audio segments having similar features (715).

The supervised multi-class detector/classifier 240 may determine an i-vector from each cluster generated by the cluster unit 230 and then perform classification based on the determined i-vectors. The supervised multi-class detector/classifier 240 may classify each of the clusters of audio frames based on the type(s) of sound data each cluster includes (720). For example, the supervised multi-class detector/classifier 240 may classify a cluster as containing speech data or non-speech data, thereby determining speech clusters (250) and non-speech clusters (260) of the received audio signal (210).

The supervised multi-class detector/classifier 240 may also classify a cluster as a dishwasher cluster 251 or non-dishwasher cluster 261 or car cluster 252 or non-car cluster 262, depending on the nature of the audio the cluster contains.

The systems and methods disclosed herein are not limited to detecting speech, a dishwasher running, or sound from a car. Accordingly, the supervised multi-class detector/classifier 240 may classify a cluster as type q cluster 253 or a non-type q cluster 263, where type q refers to any object that produces a type q of sound data.

In at least one embodiment, the supervised multi-class detector/classifier 240 may determine only one class for any cluster (e.g. speech). In at least one embodiment, the supervised multi-class detector/classifier 240 may determine only one class for any cluster (e.g. speech), and any cluster not classified by the supervised multi-class detector/classifier 240 as being in the class may be deemed not in the class (e.g. non-speech).

Figure 8:
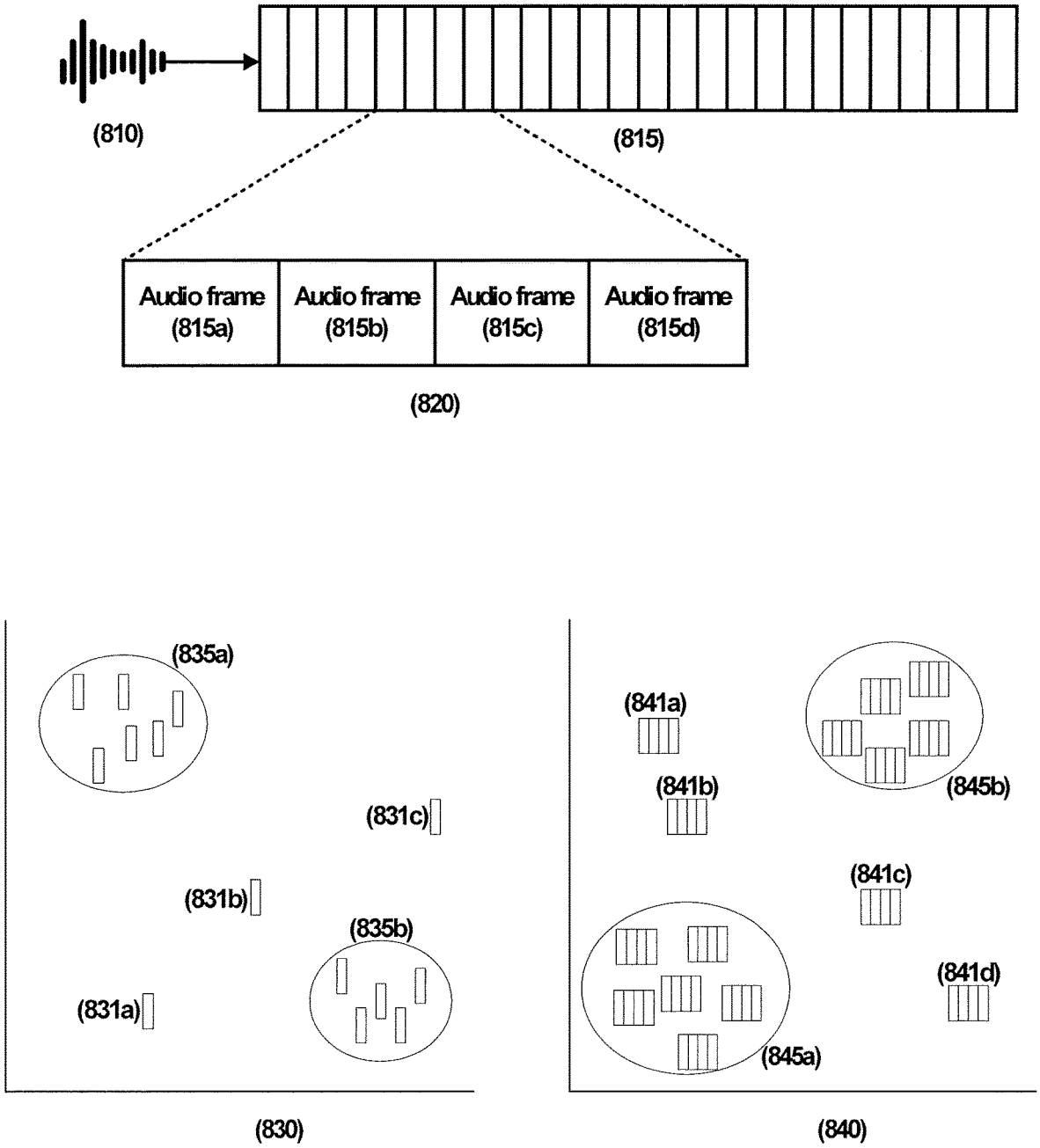
FIG. 8 illustrates an audio signal, audio frames, audio segments, and clustering according to one or more embodiments described herein.

FIG. 8 illustrates an audio signal, audio frames, audio segments, and clustering according to one or more embodiments described herein. The audio event detection system 100/200/623 may receive an audio signal 810 and may operate on audio frames 815 each having a duration of, e.g., 10 ms. Contiguous audio frames 815*a*, 815*b*, 815*c*, and 815*d* may be referred to as a segment 820. As depicted in FIG. 8, segment 820 consists of four audio frames, but the embodiments are not limited thereto. For example, a segment 820 may consist of more or less than four contiguous audio frames.

Space 830 contains clusters 835*a* and 835*b* and audio frames 831*a*, 831*b*, and 831*c*. In space 830, audio frames having a close proximity (similar features) to one another are clustered into cluster 835*a*. Audio frames 831*a*-831*c* are not assigned to any cluster. Another set of audio frames having a close proximity (similar features) to one another are clustered into cluster 835*b*.

Space 840 contains clusters 845*a* and 845*b* and segments 841*a*, 841*b*, 841*c*, and 841*d*. Segments having close proximity to one another are clustered into cluster 845*a*. Segments 841*a*-841*d* are not assigned to any cluster. Another set of segments having a close proximity to one another are clustered into cluster 845*b*. While segments 841*a*-841*d* and the segments in clusters 845*a* and 845*b* are all the same duration of time, the embodiments are not limited thereto. That is, as explained in greater detail herein, the segmentation methods and systems of this disclosure may segment an audio signal into segments of different durations.

While unassigned audio frames 831*a*-831*c* (and unassigned segments 841*a*-841*d*) are depicted, note that in at least one embodiment, each audio frame (or each segment) is assigned to a particular cluster.

Figure 3:
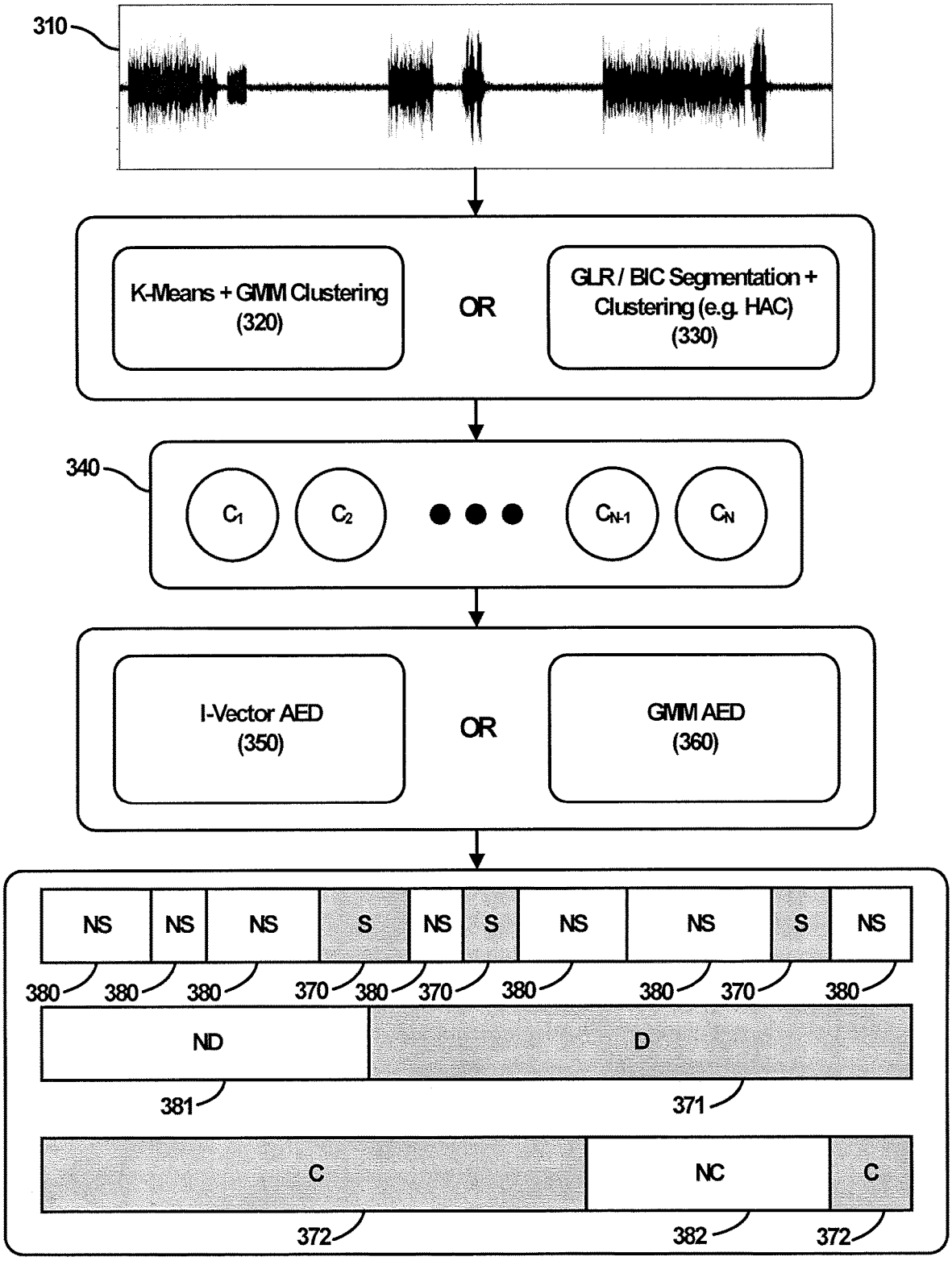
FIG. 3 is a block diagram illustrating example operations of an audio event detection system according to one or more embodiments described herein.
Figure 6:
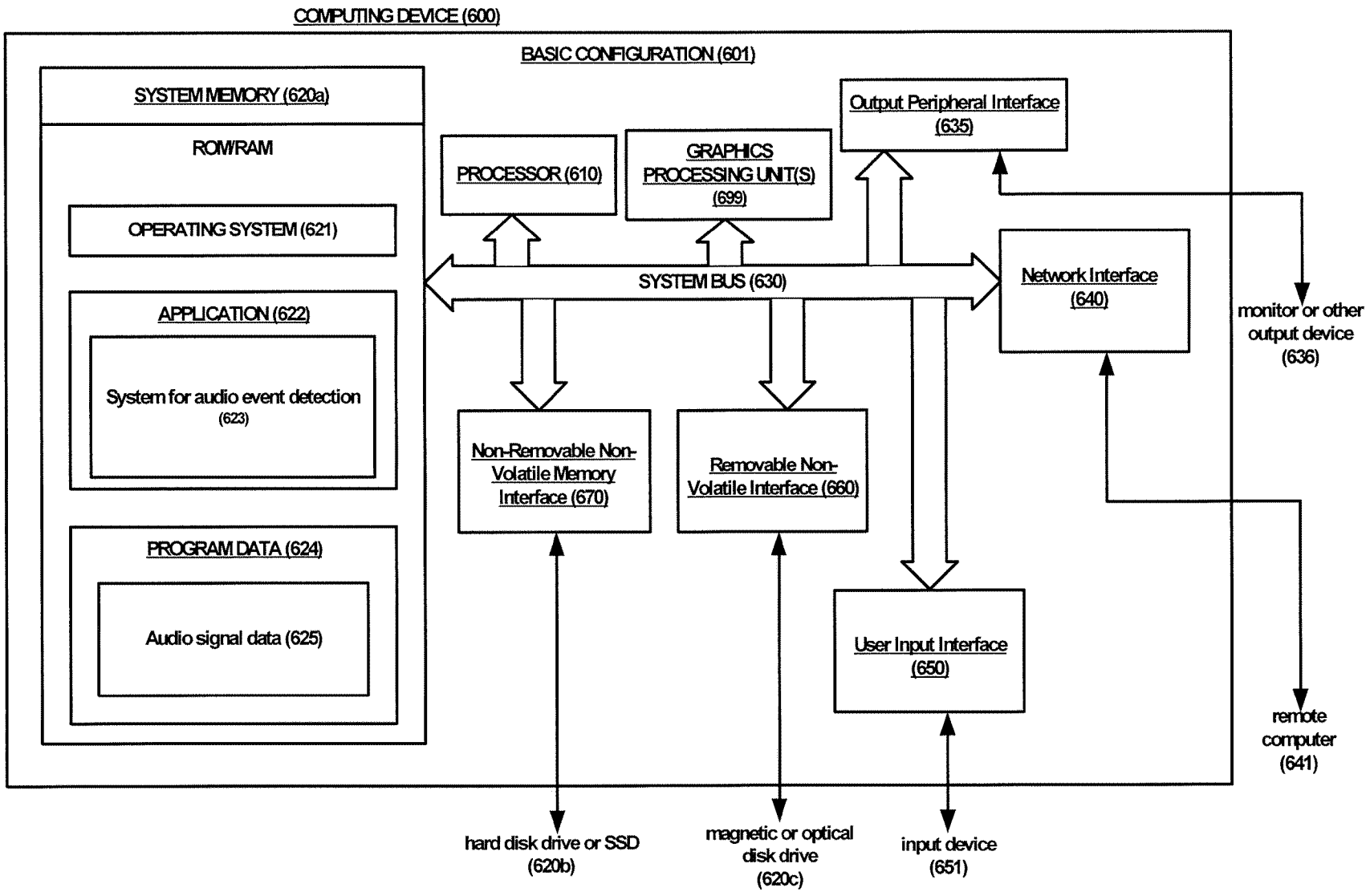
FIG. 6 is a block diagram illustrating an example computing device arranged for performing audio event detection according to one or more embodiments described herein.

FIG. 3 illustrates example operations of the audio event detection system of the present disclosure. One or more of the example operations shown in FIG. 3 may be performed by corresponding components of the example system 200 shown in FIG. 2 and described in detail above. Further, one or more of the example operations shown in FIG. 3 may be performed using computing device 600 which may run an application 622 implementing a system for audio event detection 623, as shown in FIG. 6 and described in detail below.

In at least one embodiment, audio frames (e.g. 10 ms frames) of an audio signal 310 may be clustered into clusters 340 using K-means and GMM clustering (320). In at least one other embodiment, the audio signal 310 may be segmented (where each segment is a contiguous group of frames) using a GLR/BIC segmentation technique (330), and clusters 340 of the segments may be formed using, e.g., hierarchical agglomerative clustering (HAC). The clusters of audio frames/segments 340 may then be classified into clusters containing a particular type q of sound data and clusters not containing a particular type q of sound data, e.g., speech and non-speech clusters, using Gaussian mixture models (GMM) (360) or i-vectors in combination with a supervised classifier (350). The output of the i-vector audio event detection (350) or GMM audio event detection (360) may include, for example, an identification of clusters of the audio signal 310 that contain speech data 370 and non-speech data 380. Further, the output of the i-vector AED 350 or GMM AED 360 may include, for example, identification of clusters of the audio signal 310 that contain data related to a dishwasher running 371 and data related to no dishwasher running 381 or data related to a car running 372 and data related to no car running 382. The example operations shown in FIG. 3 will be described in greater detail in the sections that follow.

Figure 5:
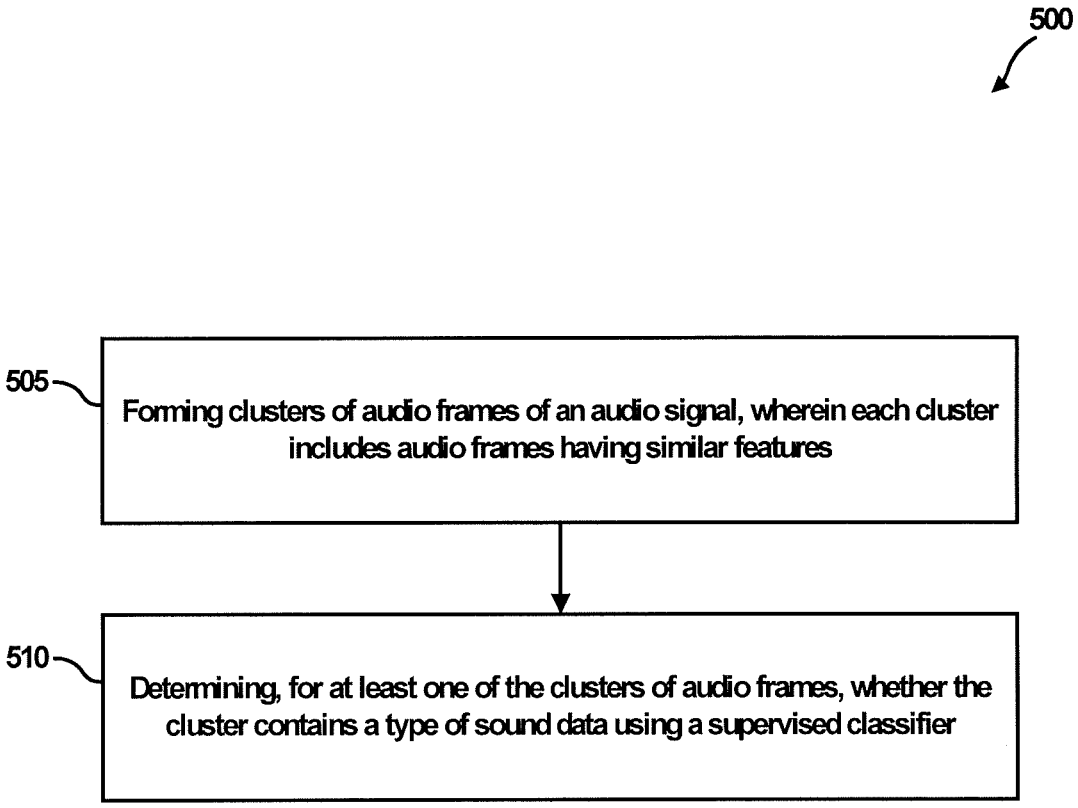
FIG. 5 is a flowchart illustrating an example method for audio event detection according to one or more embodiments described herein.

FIG. 5 shows an example method 500 for audio event detection, in accordance with one or more embodiments described herein. First, clusters of audio frames of an audio signal are formed (505), wherein each cluster includes audio frames having similar features. Second, it is determined (510), for at least one of the clusters of audio frames, whether the cluster contains a type of sound data using a supervised classifier. Each of blocks 505 and 510 in the example method 500 will be described in greater detail below.

FIG. 7 shows an example method 700 for audio event detection, in accordance with one or more embodiments described herein. At block 705, the audio signal is divided into audio frames. At block 710, feature vectors are extracted from the audio frames. Such feature vectors may include, for example, Mel-Frequency Cepstral Coefficients (MFCC), Perceptual Linear Prediction (PLP), Relative Spectral Transform—Perceptual Linear Prediction (RASTA-PLP), and the like. At block 715, the extracted feature vectors may be used to form clusters of audio frames or audio segments having similar features. At block 720, each of the clusters may be classified based on the type(s) of sound data each cluster includes.

Data Structuring

GLR/BIC Segmentation and Clustering

In accordance with one or more embodiments of the present disclosure, the methods and systems for AED described herein may include an operation of splitting an audio signal or an audio recording into segments. Once the signal or recording has been segmented, similar audio segments may be grouped or clustered using, for example, hierarchical agglomerative clustering (HAC).

Let $X=x_1, \ldots, x_{N_X}$ be a sliding window of $N_X$ feature vectors of dimension d and M its parametrical model. In at least one embodiment, M is a multivariate Gaussian. In at least one embodiment, the feature vectors may be, for example, MFCC, PLP, and/or RASTA-PLP extracted on 20 millisecond (ms) windows with a shift of 10 ms. In practice, the size of the sliding window X may be empirically set to 1 second ($N_X$=100).

The generalized likelihood ratio (GLR) may be used to select one of two hypotheses:

(1) $H_0$ assumes that X belongs to only one audio source. Thus, X is best modeled by a single multivariate Gaussian distribution:

$$(x_1, \ldots, x_{N_X}) \sim N(\mu, \sigma) \tag{1}$$

(2) $H_c$ assumes that X is shared between two different audio sources separated by a point of change c: the first source is in $X_{1,c}=x_1, \ldots, x_c$ whereas the second is in $X_{2,c}=x_{c+1}, \ldots, x_{N_X}$. Thus, the sequence is best modeled by two different multivariate Gaussian distributions:

$$(x_1, \ldots, x_c) \sim N(\mu_{1,c}, \sigma_{1,c}) \tag{2}$$

$$(x_{c+1}, \ldots, x_{N_X}) \sim N(\mu_{2,c}, \sigma_{2,c}) \tag{3}$$

Therefore, GLR is expressed by:

$$GLR(c) = \frac{P(H_0)}{P(H_c)} = \frac{L(X, M)}{L(X_{1,c}, M_{1,c}) L(X_{2,c}, M_{2,c})} \tag{4}$$

where L(X, M) is the likelihood function. Considering the log scale, R(c)=log(GLR(c)), equation (4) becomes:

$$R(c) = \frac{N_X}{2} \log\left|\sum_X\right| - \frac{N_{X_{1,c}}}{2} \log\left|\sum_{X_{1,c}}\right| - \frac{N_{X_{2,c}}}{2} \log\left|\sum_{X_{2,c}}\right| \tag{5}$$

where $\Sigma_X$, $E_{X_{1,c}}$, and $E_{X_{2,c}}$ are the covariance matrices and $N_X$, $N_{X_{1,c}}$, and $N_{X_{2,c}}$ are the number of vectors of X, $X_{1,c}$, and $X_{2,c}$, respectively. A Savitzky-Golay filter may be applied to smooth the R(c) curve. Example output of such filtering is illustrated in graphical representation 420 shown in FIG. 4.

By maximizing the likelihood, the estimated point of change $\hat{c}_{glr}$ is:

$$\hat{c}_{glr} = \underset{c}{\operatorname{argmax}} R(c) \tag{6}$$

In accordance with at least one embodiment, the GLR process described above is designed to detect a first set of candidates for segment boundaries, which are then used in a stronger detection phase based on a Bayesian information criterion (BIC). A goal of BIC is to filter out the points that are falsely detected and to adjust the remaining points. For example, the new segment boundaries may be estimated as follows:

$$\hat{c}_{bic} = \underset{c}{\operatorname{argmax}} \Delta BIC(c) \tag{7}$$

where $$\Delta BIC(c)=R(c)-\lambda P \tag{8}$$

and preserved if $\Delta BIC(\hat{c}_{bic})\geq 0$. As shown in equation (8), the BIC criterion derives from GLR with an additional penalty term $\lambda P$ which may depend on the size of the search window. The penalty term $\lambda P$ may be defined as follows:

$$P=\frac{1}{2}\left(d+\frac{1}{2}d(d+1)\right)\log N_X \tag{9}$$

where d is the dimension of the feature space. Note d is constant for a particular application, and thus the magnitude of $N_X$ is the critical part of the penalty term.

Figure 4:
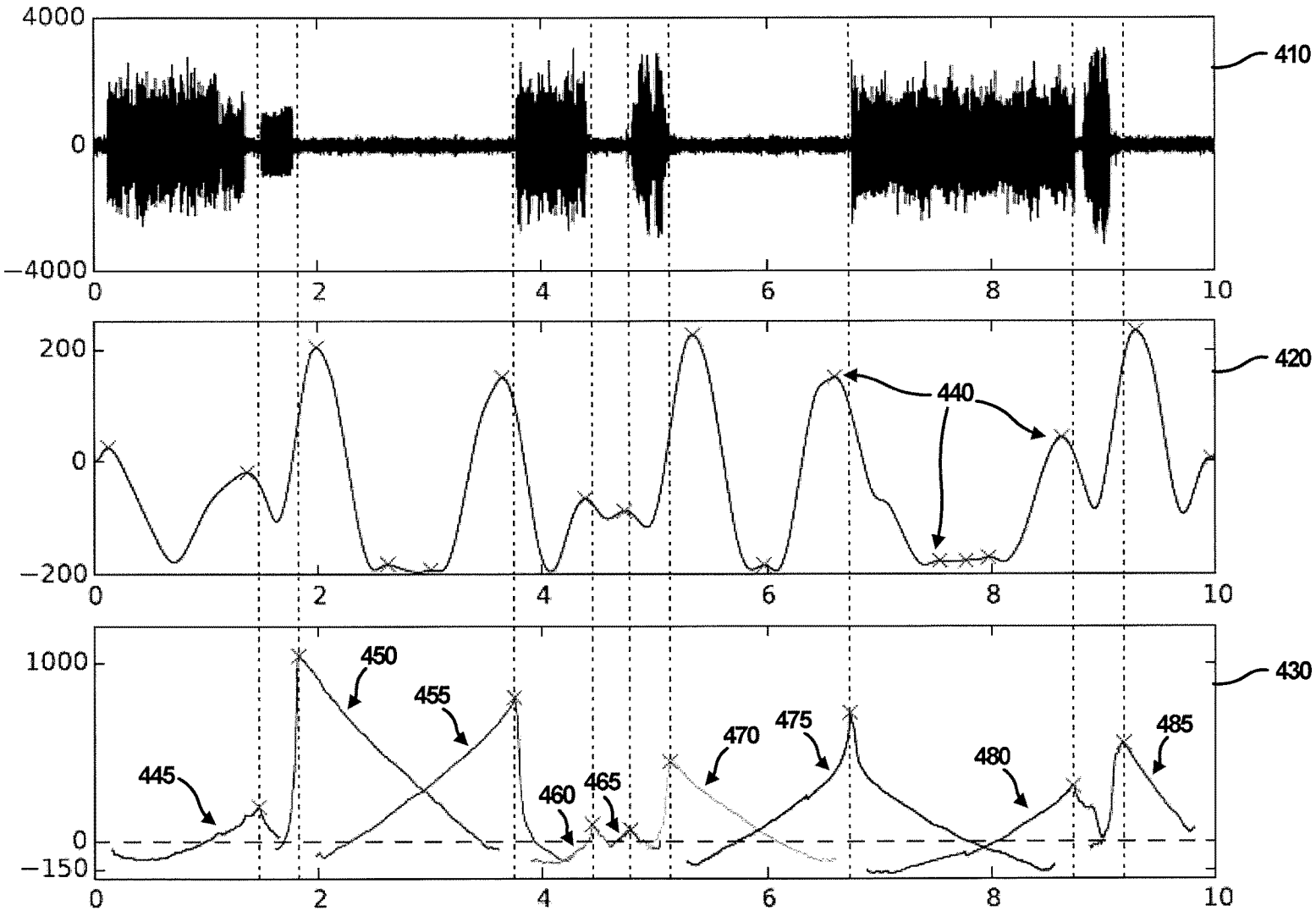
FIG. 4 is a set of graphical representations illustrating example results of audio signal segmentation and clustering according to one or more embodiments described herein.

Graphical representation 410 as shown in FIG. 4 plots a 10-second audio signal. The actual responses of smoothed GLR and BIC are shown in graphical representations 420 and 430, respectively. Curves 445 to 485 in the graphical representation 430 correspond to equation (8) applied on a single window each. The local maxima are the estimated boundaries of the segments and accurately match the ground truth.

In accordance with at least one embodiment, the resulting segments are grouped by hierarchical agglomerative clustering (HAC) and the same BIC distance measure used in equation (8). Unbalanced clusters may be avoided by introducing a constraint on the size of the clusters, and a stopping criterion may be when all clusters have duration higher than $D_{min}$. In at least one embodiment, $D_{min}$ is set to 5 seconds.

Various blind source separation techniques exist that separate temporally overlapping audio sources. In at least one embodiment, it may be desirable to separate temporally overlapping audio sources, e.g., prior to segmentation and clustering, using a blind source separation technique such as independent component analysis (ICA).

K-Means and GMM Clustering

K-means and GMM clustering may be applied to audio event detection to form clusters to be classified. In at least one embodiment, in K-means and GMM clustering, a cluster is a group of audio frames.

K-means may be used to find an initial partition of data relatively quickly. GMM clustering may then be used to refine this partition using a more computationally expensive update. Both K-means and GMM clustering may use an expectation maximization (EM) algorithm. While K-means uses Euclidean distance to update the means, GMM clustering uses a probabilistic framework to update the means, the variances, and the weights.

K-means and GMM clustering can be accomplished using an Expectation Maximization (EM) approach to maximize the likelihood, or to find a local maximum (or approximate a local maximum) of the likelihood, over all the features of the audio recording. This partition-based clustering is faster than the hierarchical clustering method described above and does not require a stopping criterion. However, for K-means and GMM clustering it is necessary for the number of clusters (k) to be set in advance. For example, in accordance with at least one embodiment described herein, k is selected to be dependent on the duration of the full recording $D_{recording}$:

$$k=\left\lceil\frac{D_{recording}}{D_{avg}}\right\rceil+1 \tag{10}$$

where $D_{avg}$ is the average duration of the clusters and $\lceil\ \rceil$ denotes the ceiling function. $D_{avg}$ may be set, for example, to 5 seconds. It should be noted that the minimum number of clusters in equation (10) is two. This makes SAD possible for utterances shorter than $D_{avg}$ and makes AED possible for sounds shorter than $D_{avg}$.

Note that K-means and GMM clustering generalizes to include the cases where certain audio frames contain more than one audio source or overlapping audio sources. In at least one embodiment, some clusters formed by K-means and GMM clustering may include audio frames from one source and other clusters formed by K-means and GMM clustering may include audio frames from overlapping audio sources.

Classifiers for Speech Activity Detection and Audio Event Detection

A cluster C may have a type q of sound data:

$$q\in\{\text{Speech,NonSpeech}\} \tag{11.1}$$

According to one or more embodiments, the methods and systems described herein include classifying each cluster C as either "Speech" or "NonSpeech", but the embodiments are not limited thereto. The types q may not be limited to the labels provided in this disclosure and may be chosen based on the labels desired for the sound data on which the systems and methods disclosed herein operate.

According to one or more embodiments, the methods and systems described herein include classifying or determining a cluster C according to its membership in one or more types q of sound data. For example, $$q\in\left\{\begin{matrix}\text{Speech, } NonSpeech, CarRunning, NotCarRunning,\\ MicrowaveRunning, MicrowaveNotRunning\end{matrix}\right\} \tag{11.2}$$

According to one or more embodiments, it may not be necessary to include categories that indicate the absence of a particular type q of sound data. For example, $$q\in\left\{\begin{matrix}\text{Speech, } CarRunning,\\ MicrowaveRunning\end{matrix}\right\} \tag{11.3}$$

In some embodiments, a cluster C need not be labeled as having exactly one type q of sound data and need not be labeled as having a certain number of types q of sound data. For example, a cluster $C_1$ may be labeled as having three types $q_1$, $q_2$, $q_3$ of sound data, whereas a cluster $C_2$ may be labeled as having five types $q_3$, $q_4$, $q_5$, $q_6$, $q_7$ of sound data.

Further details on the classification techniques of the present disclosure are provided in the sections that follow.

Gaussian Mixture Models

In at least one embodiment, a cluster $C_t$ is a cluster of different instances (e.g. a frame having a duration of 10 ms) of audio. In at least one embodiment, a feature vector extracted at every frame may include MFCC, PLP, RASTA-PLP, and/or the like.

In accordance with at least one embodiment, GMMs may be used for AED. To use GMMs for AED, it is necessary to learn a GMM $G_q=\{w_q,\mu_q,\Sigma_q\}$ for each type q of sound data. For example, GMMs may be learned from a set of enrollment samples, where the training is done using the expectation maximization (EM) algorithm to seek a maximum-likelihood estimate.

Once type-specific models $G_k$ are trained, the probability that a test cluster $C_t$ is from (or belongs to) a certain type q of sound data, e.g., "Source", is given by a log-likelihood ratio (LLR) score:

$$h_{gmm}(C_t)=\ln p(C_t|G_{Source})-\ln p(C_t|G_{NonSource}) \quad (12)$$

In at least one embodiment, a cluster may be classified as having temporally overlapping audio sources. If a LLR score of a test cluster $C_t$ meets or exceeds thresholds for two different types $q_1$ and $q_2$ of sound data, $C_t$ may be classified as types $q_1$ and $q_2$. More generally, if a LLR score of a test cluster $C_t$ meets or exceeds thresholds for at least two different types of sound data, $C_t$ may be classified as each of the types of sound data for which the LLR score for test cluster $C_t$ meets or exceeds the threshold for the type.

I-Vectors

In accordance with one or more other embodiments of the present disclosure, classification for AED may be performed using total variability modeling, which aims to extract low-dimensional vectors $\omega_{i,j}$, known as i-vectors, from clusters $C_{i,j}$, using the following expression:

$$\mu=m+T\omega \quad (13)$$

where $\mu$ is the supervector (e.g., GMM supervector) of $C_{i,j}$, m is the supervector of the universal background model (UBM) for the type q of sound data, T is the low-dimensional total variability matrix, and $\omega$ is the low-dimensional i-vector, which may be assumed to follow a standard normal distribution $\mathcal{N}(0,I)$. In at least one embodiment, $\mu$ may be normally distributed with mean m and covariance matrix $TT^t$.

In at least one embodiment, the process for learning the total variability subspace T relies on an EM algorithm that maximizes the likelihood over the training set of instances labeled with a type q of sound data. In at least one embodiment, the total variability matrix is learned at training time, and the total variability matrix is used to compute the i-vector $\omega$ at test time.

I-Vectors are extracted as follows: all feature vectors of a cluster are used to compute zero-order (Z), and first-order statistics (F) of the cluster. First-order statistics F vector is then projected to a lower-dimension space using both the total variability matrix T and the zero-order statistics Z. The projected vector is the so-called i-vector.

Once i-vectors are extracted, whitening and length normalization may be applied for channel compensation purposes. Whitening consists of normalizing the i-vector space such that the covariance matrix of the i-vectors, of a training set, is turned into the identity matrix. Length normalization aims at reducing the mismatch between training and test i-vectors.

In accordance with at least one embodiment, probabilistic linear discriminant analysis (PLDA) may be used as the back-end classifier that assigns label(s) to each test cluster $C_t$ depending on the i-vector associated with test cluster $C_t$. In accordance with at least one other embodiment, one or more support vector machines (SVMs) may be used for classifying each test cluster $C_t$ between or among the various types q of sound data depending on the i-vector associated with the test cluster $C_t$.

For PLDA, the LLR of a test cluster $C_t$ being from a particular class, e.g., "Source", is expressed as follows:

$$h_{plda}(C_t) = \frac{p(\omega_t, \omega_{Source} \mid \Theta)}{p(\omega_t \mid \Theta)p(\omega_{Source} \mid \Theta)} \quad (14)$$

where $\omega_t$ is the test i-vector, $\omega_{Source}$ is the mean of source i-vectors, and $\Theta=\{F, G, \Sigma_{\epsilon}\}$ is the PLDA model. $\omega_{Source}$ is computed at training time. Several training clusters may belong to one source, and one i-vector per cluster is extracted. When several training clusters belong to one source, there are several i-vectors for that source. Therefore, for a particular source, $\omega_{Source}$ is the average i-vector for the particular source.

In equation (14), F and G are the between-class and within-class (where "class" refers to a particular type q of sound data) covariance matrices, and $\Sigma_{\epsilon}$ is the covariance of the residual noise. F and G are estimated via an EM algorithm. EM is used to maximize the likelihood of F and G over the training data.

For SVM, Platt scaling may be used to transform SVM scores into probability estimates as follows:

$$h_{svm}(C_t) = \frac{1}{1+\exp(Af(\omega_t)+B)} \quad (15)$$

where $f(\omega_t)$ is the uncalibrated score of the test sample obtained from SVM, A and B are learned on the training set using maximum-likelihood estimation, and $h_{svm}(C_t)\in[0,1]$.

In at least one embodiment, SVM may be used with a radial basis function kernel instead of a linear kernel. In at least one other embodiment, SVM may be used with a linear kernel.

In at least one embodiment, equation (15) is used to classify $C_t$ with respect to a type q of sound data. In at least one embodiment, if $h_{svm}(C_t)$ is greater than or equal to a threshold probability for a type q of sound data, $C_t$ may be labeled as type q. In at least one embodiment, $C_t$ could be labeled as having multiple types q of sound data. For example, assume a threshold probability required to classify a cluster as CarRunning is 0.8 and a threshold probability required to classify a cluster as MicrowaveRunning is 0.81. Let $h_{CarRunning}(C_t)$ represent a probability estimate (obtained from equation (15)) that $C_t$ belongs to CarRunning, and let $h_{MicrowaveRunning}(C_t)$ represent a probability estimate (obtained from equation (15)) that $C_t$ belongs to MicrowaveRunning. If, in an embodiment including a multi-class SVM classifier, $h_{CarRunning}(C_t)=0.9$ and $h_{MicrowaveRunning}(C_t)=0.93$, then $C_t$ belongs to classes CarRunning and MicrowaveRunning.

It should be noted that experiments carried out on a large data set of phone calls collected under severe channel artifacts show that the methods and systems of the present disclosure outperform a state-of-the-art frame-based GMM system by a significant percentage.

Score Fusion

In accordance with one or more embodiments, a score-level fusion may be applied over the different features' (e.g., MFCC, PLP, and RASTA-PLP) individual AED systems to demonstrate that cluster-based AED provides a benefit over frame-based AED.

In at least one embodiment, each cluster-based AED system includes clusters of frames (or segments). One type of feature vector (e.g. MFCC, PLP, or RASTA-PLP) is extracted in each system. The clusters are then classified with a certain classifier, the same classifier used in each system. In at least one embodiment, the scores for each of these systems are fused, and the fused score is compared with a score for a frame-based AED system using the same classifier.

In at least one embodiment, scores may be fused over different types of feature vectors. In other words, there might be one fused score for i-vector+PLDA, where the components of the fused score are three different systems, each system for one feature type from the set {MFCC, PLP, RASTA-PLP}.

Figure 9:
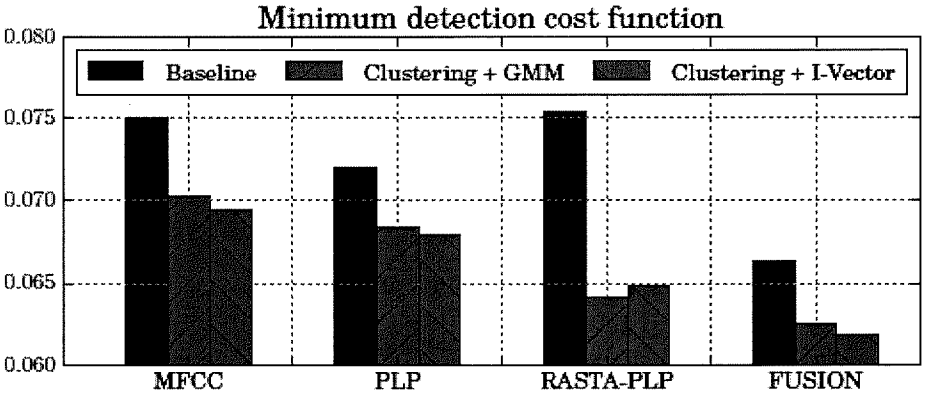
FIG. 9 illustrates results using clustering and Gaussian Mixture Models (GMMs), clustering and i-vectors, and a baseline conventional system for three different feature types and for a fusion of the three different feature types given a particular data set, according to one or more embodiments described herein.

FIG. 9 illustrates results using clustering and Gaussian Mixture Models (GMMs), clustering and i-vectors, and a baseline conventional system for three different feature types and for a fusion of the three different feature types given a particular data set, according to one or more embodiments described herein.

In accordance with at least one embodiment, a logistic regression approach is used. Let a test cluster $C_t$ be processed by $N_s$ AED systems. Each system produces an output score denoted by $h_s(C_t)$. The final fused score is expressed by the logistic function:

$$h_{fusion}(C_t) = g\left(\alpha_0 + \sum_{s=1}^{N} \alpha_s h_s(C_t)\right) \tag{16}$$

where $$g(x) = \frac{1}{1 + \exp(-x)} \tag{17}$$

and $\alpha=[\alpha_0, \alpha_1, \ldots, \alpha_N]$ are the regression coefficients.

Evaluation

GLR/BIC clustering and K-means+GMM clustering, result in a set of clusters that are relatively highly pure. Example purities of clusters and SAD accuracies for the various methods described herein are shown below in Table 1. Accuracy is represented by the minimum detection cost function (minDCF): the lower the minDCF is, the higher the accuracy of the SAD system is. The following table is based on a test of an example embodiment using specific data. Other embodiments and other data may yield different results.

TABLE 1

| Method | Metric | MFCC | PLP | RASTA-PLP |
|---|---|---|---|---|
| Segmentation | Purity (%) | 94.5 | 94.2 | 93.6 |
| | minDCF | 0.131 | 0.134 | 0.142 |
| Segmentation + HAC | Purity (%) | 92.2 | 91.8 | 90.9 |
| | minDCF | 0.122 | 0.124 | 0.122 |
| K-Means | Purity (%) | 84.2 | 86.8 | 85.4 |
| | minDCF | 0.237 | 0.226 | 0.250 |
| K-Means + GMM | Purity (%) | 88.7 | 90.2 | 90.2 |
| | minDCF | 0.211 | 0.196 | 0.210 |

As used herein, the term "temporally overlapping audio" refers to audio from at least two audio sources that overlaps for some portion of time. If at least a portion of first audio emitted by a first audio source occurs at the same time as at least a portion of second audio emitted by a second audio source, it may be said that the first audio and second audio are temporally overlapping audio. It is not necessary that the first audio begin at the same time as the second audio for the first audio and second audio to be temporally overlapping audio. Further, it is not necessary that the first audio end at the same time as the second audio for the first audio and second audio to be temporally overlapping audio.

In at least one embodiment, the term "multi-class cluster" refers to a cluster of audio frames, wherein at least two of the audio frames in the cluster have features extracted from temporally overlapping audio. In at least one embodiment, the term "multi-class cluster" refers to a cluster of segments, wherein at least two of the segments in the cluster have features extracted from temporally overlapping audio.

In an example embodiment, a n-class classifier is a classifier that can score (or classify) n different classes (e.g. n different types $q_1, q_2, \ldots, q_n$ of sound data) of instances (e.g. clusters). An example of a n-class classifier is a n-class SVM. In an example embodiment, a n-class classifier (e.g. a n-class SVM) is a classifier that can score (or classify) an instance (e.g. a multi-class cluster) as belonging (or likely or possibly belonging) to n different classes (e.g. n different types $q_1, q_2, \ldots, q_n$ of sound data), wherein the instance includes features (or one or more feature vectors) extracted from temporally overlapping audio. As used herein, "extracting", when used in a context like "extracting a feature", may, in at least one embodiment, include determining a feature. The extracted feature need not be a hidden variable. In at least one embodiment, a n-class classifier is a classifier that can score (or classify) n different classes (e.g. n different types $q_1, q_2, \ldots, q_n$ of sound data) of instances (e.g. clusters) by providing n different probability estimates, one probability estimate for each of n different types $q_1, q_2, \ldots, q_n$ of sound data. In at least one embodiment, a n-class classifier is a classifier that can score (or classify) n different classes (e.g. n different types $q_1, q_2, \ldots, q_n$ of sound data) of instances (e.g. clusters) by providing n different probability estimates, one probability estimate for each of n different types $q_1, q_2, \ldots, q_n$ of sound data. A n-class classifier is an example of a multi-class classifier. A n-class SVM is an example of a multi-class SVM.

In an example embodiment, a multi-class classifier is a classifier that can score (or classify) at least two different classes (e.g. two different types $q_1$ and $q_2$ of sound data) of instances (e.g. clusters). In an example embodiment, a multi-class classifier is a classifier that can score (or classify) an instance (e.g. a multi-class cluster) as belonging (or likely or possibly belonging) to at least two different classes (e.g. two different types $q_1$ and $q_2$ of sound data), wherein the instance includes features (or one or more feature vectors) extracted from temporally overlapping audio. A multi-class SVM is an example of a multi-class classifier.

As used herein, a "score" may be, without limitation, a classification or a class, an output of a classifier (e.g. an output of a SVM), or a probability or a probability estimate.

An audio source emits audio. An audio source may be, without limitation, a person, a person speaking on a telephone, a passenger vehicle, a telephone, a location environment, an electrical device, or a mechanical device. A telephone may be, without limitation, a landline phone that transmits analog signals, a cellular phone, a smartphone, a Voice over Internet Protocol (VoIP) phone, a softphone, a phone capable of transmitting dual tone multi frequency (DTMF), a phone capable of transmitting RTP packets, or a phone capable of transmitting RFC 2833 or RFC 4733 packets. A passenger vehicle is any vehicle that may transport people or goods including, without limitation, a plane, a train, a car, a truck, a SUV, a bus, a boat, etc. The term "location environment" refers to a location including its environment. For example, classes of location environment include a restaurant, a train station, an airport, a kitchen, an office, and a stadium.

An audio signal from a telephone may be in the form of, without limitation, an analog signal and/or data (e.g. digital data, data packets, RTP packets). Similarly, audio transmitted by a telephone may be transmitted by, without limitation, an analog signal and/or data (e.g. digital data, data packets, RTP packets).

FIG. 6 is a high-level block diagram of an example computing device (600) that is arranged for audio event detection using GMM(s) or i-vectors in combination with a supervised classifier in accordance with one or more embodiments described herein. For example, in accordance with at least one embodiment, computing device (600) may be (or may be a part of or include) audio event detection system 100 as shown in FIG. 1 and described in detail above.

In a very basic configuration (601), the computing device (600) typically includes one or more processors (610) and system memory (620*a*). A system bus (630) can be used for communicating between the processor (610) and the system memory (620*a*).

Depending on the desired configuration, the processor (610) can be of any type including but not limited to a microprocessor (μP), a microcontroller (μC), a digital signal processor (DSP), or any combination thereof. The processor (610) can include one more levels of caching, a processor core, and registers. The processor core can include an arithmetic logic unit (ALU), a floating point unit (FPU), a digital signal processing core (DSP Core), or the like, or any combination thereof. A memory controller can also be used with the processor (610), or in some implementations the memory controller can be an internal part of the processor (610).

Depending on the desired configuration, the system memory (620*a*) can be of any type including but not limited to volatile memory (such as RAM), non-volatile memory (such as ROM, flash memory, etc.) or any combination thereof. System memory (620*a*) typically includes an operating system (621), one or more applications (622), and program data (624). The application (622) may include a system for audio event detection (623) which may implement, without limitation, the audio event detection system 100 (including audio event detection 140), the audio event detection system 200, one or more of the example operations shown in FIG. 3, the example method 500, the example method 700, the definition of segments 820, the mapping to spaces 830 and/or 840, the assignment of audio frames to clusters 835*a* and 835*b*, and/or the assignment of audio segments to clusters 845*a* and 845*b*. In accordance with at least one embodiment of the present disclosure, the system for audio event detection (623) is designed to divide an audio signal into audio frames, form clusters of audio frames or segments having similar features, extract an i-vector for each of the clusters of segments, and classify each cluster according to a type q of sound data based on the extracted i-vector. In accordance with at least one embodiment of the present disclosure, the system for audio event detection (623) is designed to divide an audio signal into audio frames, form clusters of audio frames or segments having similar features, learn a GMM for each type q of sound data, and classify clusters using the learned GMM(s). In accordance with at least one embodiment, the system for audio event detection (623) is designed to cluster audio frames using K-means and GMM clustering. In accordance with at least one embodiment, the system for audio event detection (623) is designed to cluster audio segments using GLR and BIC techniques.

Program Data (624) may include stored instructions that, when executed by the one or more processing devices, implement a system (623) and method for audio event detection using GMM(s) or i-vectors in combination with a supervised classifier. Additionally, in accordance with at least one embodiment, program data (624) may include audio signal data (625), which may relate to, for example, an audio signal received at or input to a processor (e.g., processor 130 as shown in FIG. 1). In accordance with at least some embodiments, the application (622) can be arranged to operate with program data (624) on an operating system (621).

The computing device (600) can have additional features or functionality, and additional interfaces to facilitate communications between the basic configuration (601) and any required devices and interfaces, such non-removable non-volatile memory interface (670), removable non-volatile interface (660), user input interface (650), network interface (640), and output peripheral interface (635). A hard disk drive or SSD (620*b*) may be connected to the system bus (630) through a non-removable non-volatile memory interface (670). A magnetic or optical disk drive (620*c*) may be connected to the system bus (630) by the removable non-volatile interface (660). A user of the computing device (600) may interact with the computing device (600) through input devices (651) such as a keyboard, mouse, or other input peripheral connected through a user input interface (650). A monitor or other output peripheral device (636) may be connected to the computing device (600) through an output peripheral interface (635) in order to provide output from the computing device (600) to a user or another device.

System memory (620*a*) is an example of computer storage media. Computer storage media includes, but is not limited to, RAM, ROM, EEPROM, flash memory or other memory technology, CD-ROM, digital versatile disk (DVD), Blu-ray Disc (BD) or other optical storage, magnetic cassettes, magnetic tape, magnetic disk storage or other magnetic storage devices, or any other medium which can be used to store the desired information and which can be accessed by computing device (600). Any such computer storage media can be part of the device (600). One or more graphics processing units (GPUs) (699) may be connected to the system bus (630) to provide computing capability in coordination with the processor (610), including when single instruction, multiple data (SIMD) problems are present.

The computing device (600) may be implemented in an integrated circuit, such as a microcontroller or a system on a chip (SoC), or it may be implemented as a portion of a small-form factor portable (or mobile) electronic device such as a cell phone, a smartphone, a personal data assistant (PDA), a personal media player device, a tablet computer (tablet), a wireless web-watch device, a personal headset device, an application-specific device, or a hybrid device that includes any of the above functions. In addition, the computing device (600) may be implemented as a personal computer including both laptop computer and non-laptop computer configurations, one or more servers, Internet of Things systems, and the like. Additionally, the computing device (600) may operate in a networked environment where it is connected to one or more remote computers over a network using the network interface (650).

Those having ordinary skill in the art recognize that some of the matter disclosed herein may be implemented in software and that some of the matter disclosed herein may be implemented in hardware. Further, those having ordinary skill in the art recognize that some of the matter disclosed herein that may be implemented in software may be implemented in hardware and that some of the matter disclosed herein that may be implemented in hardware may be implemented in software. As used herein, "implemented in hardware" includes integrated circuitry including an application-specific integrated circuit (ASIC), a field programmable gate array (FPGA), a digital signal processor (DSP), an audio coprocessor, and the like.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. Those skilled in the art will appreciate that the mechanisms of the subject matter described herein are capable of being distributed as a program product in a variety of forms, and that an illustrative embodiment of the subject matter described herein applies regardless of the type of non-transitory signal bearing medium used to carry out the distribution. Examples of a non-transitory signal bearing medium include, but are not limited to, the following: a recordable type medium such as a floppy disk, a hard disk drive, a solid state drive (SSD), a Compact Disc (CD), a Digital Video Disk (DVD), a Blu-ray disc (BD), a digital tape, a computer memory, etc.

The terms "component," "module," "system," "database," and the like, as used in the present disclosure, refer to a computer-related entity, which may be, for example, hardware, software, firmware, a combination of hardware and software, or software in execution. A "component" may be, for example, but is not limited to, a processor, an object, a process running on a processor, an executable, a program, an execution thread, and/or a computer. In at least one example, an application running on a computing device, as well as the computing device itself, may both be a component.

It should also be noted that one or more components may reside within a process and/or execution thread, a component may be localized on one computer and/or distributed between multiple (e.g., two or more) computers, and such components may execute from various computer-readable media having a variety of data structures stored thereon.

Unless expressly limited by the respective context, where used in the present disclosure, the term "generating" indicates any of its ordinary meanings, such as, for example, computing or otherwise producing, the term "calculating" indicates any of its ordinary meanings, such as, for example, computing, evaluating, estimating, and/or selecting from a plurality of values, the term "obtaining" indicates any of its ordinary meanings, such as, for example, receiving (e.g., from an external device), deriving, calculating, and/or retrieving (e.g., from an array of storage elements), and the term "selecting" indicates any of its ordinary meanings, such as, for example, identifying, indicating, applying, and/or using at least one, and fewer than all, of a set of two or more.

The term "comprising," where it is used in the present disclosure, including the claims, does not exclude other elements or operations. The term "based on" (e.g., "A is based on B") is used in the present disclosure to indicate any of its ordinary meanings, including the cases (i) "derived from" (e.g., "B is a precursor of A"), (ii) "based on at least" (e.g., "A is based on at least B") and, if appropriate in the particular context, (iii) "equal to" (e.g., "A is equal to B"). Similarly, the term "in response to" is used to indicate any of its ordinary meanings, including, for example, "in response to at least."

Unless indicated otherwise, any disclosure herein of an operation of an apparatus having a particular feature is also expressly intended to disclose a method having an analogous feature (and vice versa), and any disclosure of an operation of an apparatus according to a particular configuration is also expressly intended to disclose a method according to an analogous configuration (and vice versa). Where the term "configuration" is used, it may be in reference to a method, system, and/or apparatus as indicated by the particular context. The terms "method," "process," "technique," and "operation" are used generically and interchangeably unless otherwise indicated by the context. Similarly, the terms "apparatus" and "device" are also used generically and interchangeably unless otherwise indicated by the context. The terms "element" and "module" are typically used to indicate a portion of a greater configuration. Unless expressly limited by its context, the term "system" is used herein to indicate any of its ordinary meanings, including, for example, "a group of elements that interact to serve a common purpose."

With respect to the use of substantially any plural and/or singular terms herein, those having ordinary skill in the art can translate from the plural to the singular and/or from the singular to the plural as is appropriate to the context and/or application. The various singular/plural permutations may be expressly set forth herein for sake of clarity.

Embodiments of the subject matter have been described. Other embodiments are within the scope of the following claims. In some cases, the actions recited in the claims can be performed in a different order and still achieve desirable results. In addition, the processes depicted in the accompanying figures do not necessarily require the order shown, or sequential order, to achieve desirable results. In certain implementations, multitasking and parallel processing may be advantageous.

The invention claimed is:

1. A computer-implemented method for audio event detection, comprising:

partitioning, by a computer, an audio signal into a plurality of audio frames;

clustering, by the computer, the plurality of audio frames into a plurality of clusters containing audio frames having similar features, wherein the plurality of clusters include at least one multi-class cluster; and detecting, by the computer utilizing a supervised classifier of a plurality of supervised classifiers, an audio event in the at least one multi-class cluster of the plurality of clusters, wherein at least one supervised classifier is a supervised multi-class classifier trained on multi-class training clusters.

2. The computer-implemented method of claim 1, further comprising utilizing, by the computer, K-means to identify an initial partition of the audio signal from the plurality of audio frames.

3. The computer-implemented method of claim 1, wherein the computer; utilizes at least one Gaussian mixture model to cluster the plurality of audio frames to the plurality of clusters.

4. The computer-implemented method of claim 1, further comprising:

extracting, by the computer, an i-vector for the at least one multi-class cluster; and detecting, by the computer, the audio event in the at least one multi-class cluster based upon the extracted i-vector.

5. The computer-implemented method of claim 1, wherein the supervised classifier utilizes probabilistic linear discriminant analysis.

6. The computer-implemented method of claim 1, wherein the supervised classifier utilizes a support vector machine.

7. The computer-implemented method of claim 1, wherein the supervised classifier utilizes a Gaussian mixture model.

8. The computer-implemented method of claim 1, further comprising:

generating, by the computer, a plurality of segments from the audio signal using generalized likelihood ratio and Bayesian information criterion.

9. The computer-implemented method of claim 8, further comprising:

detecting, by the computer, a set of candidates for segment boundaries utilizing the general likelihood ratio; and filtering out, by the computer, at least one of the candidates utilizing the Bayesian information criterion.

10. The computer-implemented method of claim 8, further comprising:

clustering, by the computer, the plurality of segments utilizing hierarchical agglomerative clustering.

11. A system comprising:

a non-transitory storage medium storing a plurality of computer program instructions;

a processor electrically coupled to the non-transitory storage medium and configured to execute the plurality of computer program instructions to:

partition an audio signal into a plurality of audio frames;

cluster the plurality of audio frames into a plurality of clusters containing audio frames having similar features, wherein the plurality of clusters include at least one multi-class cluster; and detect utilizing a supervised classifier of a plurality of classifiers, an audio event in the at least one multi-class cluster of the plurality of clusters, wherein at least one supervised classifier is a supervised multi-class classifier trained on multi-class training clusters.

12. The system of claim 11, wherein the computer utilizes K-means to identify an initial partition of the audio signal from the plurality of audio frames.

13. The system of claim 11, wherein the computer utilizes at least one Gaussian mixture model to cluster the plurality of audio frames to the plurality of clusters.

14. The system of claim 11, wherein the processor is configured to further execute the plurality of computer program instructions to:

extract an i-vector for the at least one multi-class cluster; and detect the audio event in the at least one multi-class cluster based upon the extracted i-vector.

15. The system of claim 11, wherein the supervised classifier utilizes probabilistic linear discriminant analysis.

16. The system of claim 11, wherein the supervised classifier utilizes a support vector machine.

17. The system of claim 11, wherein the supervised classifier utilizes a Gaussian mixture model.

18. The system of claim 11, wherein the processor is configured to further execute the plurality of computer program instructions to:

generate a plurality of segments from the audio signal using generalized likelihood ratio and Bayesian information criterion.

19. The system of claim 18, wherein the processor is configured to further execute the plurality of computer program instructions to:

detect a set of candidates for segment boundaries utilizing the general likelihood ratio; and filter out at least one of the candidates utilizing the Bayesian information criterion.

20. The system of claim 18, wherein the processor is configured to further execute the plurality of computer program instructions to:

cluster the plurality of segments utilizing hierarchical agglomerative clustering.

* * * * *